US010114303B2

(12) United States Patent
Katsura et al.

(10) Patent No.: US 10,114,303 B2
(45) Date of Patent: Oct. 30, 2018

(54) TONER

(71) Applicant: CANON KABUSHIKI KAISHA, Tokyo (JP)

(72) Inventors: Taiji Katsura, Suntou-gun (JP); Yasushi Katsuta, Susono (JP); Katsuyuki Nonaka, Mishima (JP); Takashi Kenmoku, Mishima (JP); Shohei Shibahara, Suntou-gun (JP); Tsutomu Shimano, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/630,635

(22) Filed: Feb. 24, 2015

(65) Prior Publication Data

US 2015/0248071 A1 Sep. 3, 2015

(30) Foreign Application Priority Data

Feb. 28, 2014 (JP) ..... 2014-038035

(51) Int. Cl.
*G03G 9/08* (2006.01)
*G03G 9/087* (2006.01)

(52) U.S. Cl.
CPC ..... *G03G 9/08755* (2013.01); *G03G 9/0821* (2013.01); *G03G 9/0825* (2013.01); *G03G 9/08782* (2013.01); *G03G 9/08795* (2013.01)

(58) Field of Classification Search
CPC ..... G03G 9/08755; G03G 9/0821; G03G 9/08782; G03G 9/0825; G03G 9/08795
(Continued)

(56) References Cited

U.S. PATENT DOCUMENTS 6,096,468 A * 8/2000 Ohno ..... G03G 9/0819 430/108.3
6,140,422 A * 10/2000 Khanarian ..... C08L 67/025 525/165

(Continued)

FOREIGN PATENT DOCUMENTS

JP 2005-107517 A 4/2005
JP 2012-220669 A 11/2012

OTHER PUBLICATIONS

U.S. Appl. No. 14/630,636, filed Feb. 24, 2015. Inventor: Katsuta, et al.

(Continued)

*Primary Examiner* — Thorl Chea
(74) *Attorney, Agent, or Firm* — Fitzpatrick Cella Harper and Scinto

(57) ABSTRACT

A toner including a toner particle that contains a binder resin, a polyester resin A and a wax, wherein the polyester resin A contains a specific amount of an isosorbide unit based on a total number of monomer units constituting the polyester resin A, the content of the polyester resin A is a specific amount, and when observing a cross-section of the toner, twenty toner particle cross-sections are selected that have a major axis R (μm) that satisfies a specific relationship with respect to the weight-average diameter D4 (μm) of the toner, each major axis r that have the largest major axis is measured for those domains composed of wax present in the selected toner particle cross-sections, and the arithmetic mean (r/R)st of the determined r/R satisfies a specific relationship.

7 Claims, 1 Drawing Sheet

(58) Field of Classification Search
USPC ..... 430/109.3
See application file for complete search history.

(56) References Cited

U.S. PATENT DOCUMENTS

| | | | | |
|---|---|---|---|---|
| 7,288,348 | B2 | 10/2007 | Hayami et al. | |
| 2008/0145775 | A1* | 6/2008 | Vijayendran | C08L 67/025 430/109.3 |
| 2012/0295196 | A1* | 11/2012 | Urban | G03G 9/08711 430/111.4 |
| 2015/0153667 | A1 | 6/2015 | Noji et al. | |
| 2015/0153668 | A1 | 6/2015 | Tanaka et al. | |
| 2015/0153669 | A1 | 6/2015 | Yoshida et al. | |
| 2015/0153670 | A1 | 6/2015 | Shimano et al. | |

OTHER PUBLICATIONS

U.S. Appl. No. 14/625,502, filed Feb. 18, 2015. Inventor: Kenmoku, et al.

J. Brandrup, et al., "Polymer Handbook" 2nd Edition, Part III, 1975, pp. 139-192 (John Wiley & Sons).

Wagner, "Dielectric Absorption and Dispersion of Mixture—Spherical Fine Particle", Phenomenalism of Dielectrics, Section 2.5.2, University Lecture Series, Institute of Electrical Engineers of Japan, 1973, pp. 145-146.

* cited by examiner

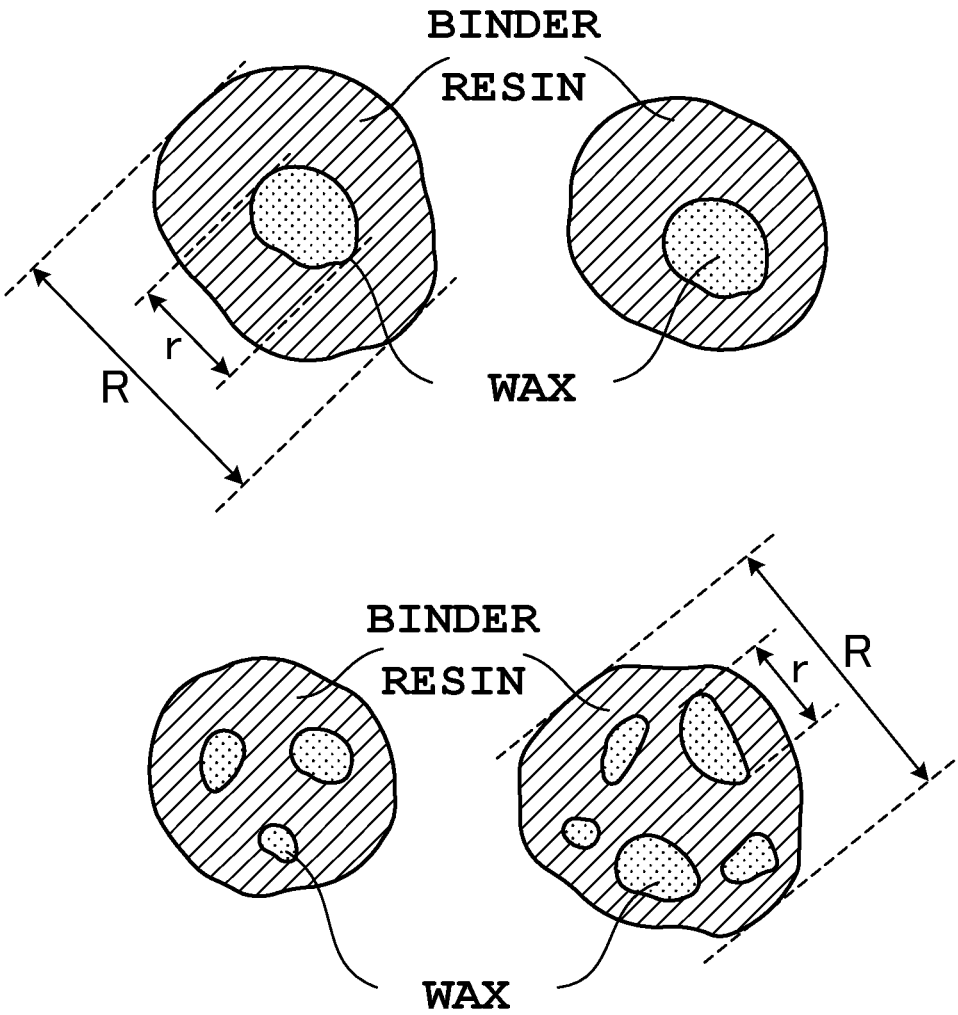
BINDER
RESIN
r
R
WAX
BINDER
RESIN
r
R
WAX

TONER

BACKGROUND OF THE INVENTION

Field of the Invention

The present invention relates to a toner for developing electrostatic images that is used in the formation of images by electrophotography.

Description of the Related Art

The quality requirements placed on image-forming apparatuses such as copiers or printers have become increasingly severe in recent years, and the performance level required of toner is becoming increasingly high. In particular, full-color copiers or full-color printers and the like are required to realize high-quality printouts regardless of the type of paper as well as demonstrate even further improvements in transferability. Toners are also being required to have even better transferability.

Japanese Patent Application Laid-open No. 2005-107517 discloses that transferability is improved by defining the average circularity and circularity of toner particles having a circle-equivalent diameter of 3.00 μm or more.

Japanese Patent Application Laid-open No. 2012-220669 discloses that uniform adhesion of an external additive to the surface of toner particles is improved and that transferability is improved by controlling toner viscoelasticity.

SUMMARY OF THE INVENTION

However, since the toner described in Japanese Patent Application Laid-open No. 2005-107517 has small average circularity and the contact area between the toner and transfer member is large, there is still room for improvement with respect to transferability.

In addition, the toner described in Japanese Patent Application Laid-open No. 2012-220669 has the possibility of an external additive becoming embedded in toner particles resulting in a decrease in toner transferability due to such factors as stress present within a developing assembly. Namely, there can still be said to be room for improvement with respect to toner durability.

The present invention solves the above-mentioned problems. Namely, the present invention provides a toner that has favorable durability and maintains high transferability during high-speed printing.

As a result of conducting extensive studies, the inventors of the present invention found that the above-mentioned problems can be solved with the toner indicated below.

Namely, the present invention is:

a toner comprising a toner particle that contains a binder resin, a polyester resin A and a wax, wherein the polyester resin A contains an isosorbide unit represented by the following formula (1), the unit being contained in a molar ratio of from at least 0.10 mol % to not more than 20.00 mol % based on a total number of monomer units constituting the polyester resin A, a content of the polyester resin A is from at least 1.0 mass part to not more than 20.0 mass parts based on 100.0 mass parts of the binder resin, and when observing a cross-section of the toner using a transmission electron microscope (TEM), a (r/R)st determined by the following procedures (1)-(4) satisfies a relationship $0.25 \leq (r/R)st \leq 0.95$, (1) selecting twenty toner particle cross-sections, wherein each of the twenty toner particle cross-sections has a major axis R (μm) that satisfies a relationship $0.9 \leq R/D4 \leq 1.1$ with respect to a weight-average diameter D4 (μm) of the toner as measured with a flow particle image measuring apparatus, (2) determining a r/R for one toner particle cross-section out of the twenty toner particle cross-sections, wherein the r (μm) denotes the largest major axis of a domain composed of the wax present in the one toner particle cross-section, (3) determining r/Rs for nineteen toner particle cross-sections other than the one toner particle cross-section in the same manner as (2) respectively, (4) calculating an arithmetic mean of twenty r/Rs to determine a (r/R)st.

[Chemical Formula 1]

formula (1)

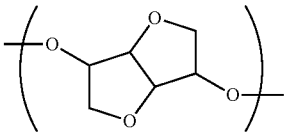

According to the present invention, a toner can be provided that demonstrates favorable durability and maintains high transferability during high-speed printing.

Further features of the present invention will become apparent from the following description of exemplary embodiments (with reference to the attached drawings).

BRIEF DESCRIPTION OF THE DRAWINGS

FIG. 1 is a schematic diagram showing one example of cross-sections of a toner that encapsulates a wax.

DESCRIPTION OF THE EMBODIMENTS

The following provides a detailed explanation of the present invention.

The toner of the present invention comprises a toner particle containing a binder resin, a polyester resin A and a wax.

In the present invention, the above-mentioned specific polyester resin contained in the toner is also referred to as "polyester resin A".

The polyester resin A used in the present invention contains an isosorbide unit represented by the following formula (1), the unit being contained in a molar ratio of from at least 0.10 mol % to not more than 20.00 mol % based on a total number of monomer units constituting the polyester resin A. Moreover, the content of the polyester resin A is from at least 1.0 mass part to not more than 20.0 mass parts based on 100.0 mass parts of the binder resin.

[Chemical Formula 2]

formula (1)

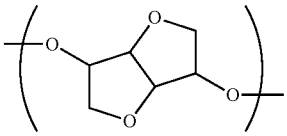

In addition, the present invention specifies a state in which a wax is contained in the toner as previously described.

More specifically, the wax in the toner is present so as to satisfy the requirements indicated below.

When observing cross-sections of the toner using a transmission electron microscope (TEM), a (r/R)st determined by the following procedures (1)-(4) satisfies a relationship $0.25 \leq (r/R)st \leq 0.95$, (1) selecting twenty toner particle cross-sections, wherein each of the twenty toner particle cross-sections has a major axis R (μm) that satisfies a relationship $0.9 \leq R/D4 \leq 1.1$ with respect to a weight-average diameter D4 (μm) of the toner as measured with a flow particle image measuring apparatus, (2) determining a r/R for one toner particle cross-section out of the twenty toner particle cross-sections, wherein the r (μm) denotes the largest major axis of a domain composed of the wax present in the one toner particle cross-section, (3) determining r/Rs for nineteen toner particle cross-sections other than the one toner particle cross-section in the same manner as (2) respectively, (4) calculating an arithmetic mean of twenty r/Rs to determine a (r/R)st.

In the toner of the present invention, high durability and favorable transferability are obtained due to a synergistic effect between the above-mentioned polyester resin A and the above-mentioned wax present in the toner. Although the reason for this is unclear, it is presumed to be as indicated below.

One of the factors that affects transferability is the attachment force between the toner and a transfer member. In general, in the case attachment force between the toner and a transfer member is large relative to electrostatic force acting on the toner by a transfer electric field, the toner remains on the transfer member in the form of untransferred toner. Thus, reducing the attachment force between the toner and transfer member is effective for improving transferability.

Attachment force between the toner and transfer member is thought to primarily be determined by the combination of image force, Van der Waals force and liquid bridging force. Although liquid bridging force may become a problem in high-humidity environments, image force and Van der Waals force are particularly important in other cases. An example of a toner property that has an effect on this attachment force is dielectric constant. In the case toner dielectric constant is high, dielectric polarization intensifies and these attachment forces tend to increase.

In the case of dielectric polarization of a toner that is a composite material of a dielectric, developing is complex and analysis from a microscopic perspective is difficult. However, it is thought that the magnitude of the dielectric polarization of a toner and its deviation have the potential to contribute to transferability. Thus, in the case of considering the transferability of a toner, it is necessary to discuss dielectric polarization of the toner from a microscopic perspective.

In general, a material with low polarity tends to have a low dielectric constant, and wax has the lowest polarity among materials normally used in toner. Wax is thought to be dispersed in one of two states in toner, consisting of a state in which it is dispersed in the toner and a state in which it is present in clumps. In general, the dielectric constant of a mixed dielectric in the case a fine particulate spherical dielectric is dispersed in a medium dielectric is known to vary depending on the dispersed state of the spherical dielectric (reference document: Phenomenalism of Dielectrics, section 2.5.2 (pages 145 to 146), University Lecture Series, Institute of Electrical Engineers of Japan).

In the case low dielectric constant spherical dielectrics are dispersed in equal amounts, the dielectric constant of the mixed dielectric has been determined by calculation to tend to become lower the larger the dispersion diameter of the spherical dielectric. Namely, in the case a wax having a low dielectric constant is present in the form of clumps, the dielectric constant of the toner decreases and polarization is presumed to tend to be inhibited. In the present invention, dielectric polarization of the toner is inhibited, attachment force of the toner on a transfer member decreases, and transferability is thought to improve as a result of realizing a state in which wax is dispersed in the toner in the manner described above.

In addition, with respect to the resin component, the introduction of a cyclic skeleton into the polymer chain is thought to suppress local molecular motion and inhibit polarization. In the present invention, toner transferability is thought to be significantly improved as a result of the isosorbide unit represented by formula (1) contained in the polyester resin A demonstrating that effect and the above-mentioned wax enhancing a polarization inhibitory effect. In addition, toner having superior durability is thought to be obtained as a result of the cyclic skeleton of the isosorbide unit imparting a certain degree of rigidity to the toner. A toner having high durability and favorable transferability is thought to be obtained due to the above-mentioned effects.

The polyester resin A used in the present invention contains the isosorbide unit represented by formula (1), the unit being contained in a molar ratio of from at least 0.10 mol % to not more than 20.00 mol % based on a total number of monomer units constituting the polyester resin A.

In the case the molar ratio of the isosorbide unit is less than 0.10 mol %, the effect of improving transferability cannot be adequately obtained. This is thought to be the result of it becoming difficult to obtain a polarization inhibitory effect and rigidity-imparting effect by introducing the above-mentioned cyclic skeleton.

On the other hand, transferability decreases in the case the molar ratio of the isosorbide unit exceeds 20.00 mol %. Since the isosorbide unit is highly hydrophilic, in the case the amount thereof is increased, hygroscopicity of the polyester resin A tends to increase. In the case the molar ratio of the isosorbide unit exceeds 20.00 mol %, the hygroscopicity of the polyester resin A increases and this is thought to cause a decrease in charging characteristics of the toner.

The molar ratio of the isosorbide unit is preferably from at least 1.00 mol % to not more than 15.00 mol %.

In addition, in the present invention, the content of the above-mentioned polyester resin A is from at least 1.0 mass part to not more than 20.0 mass parts based on 100 mass parts of the binder resin.

In the case the content of the polyester resin A is less than 1.0 mass part, the effect of improving transferability cannot be adequately obtained. This is thought to be the result of it becoming difficult to obtain a polarization inhibitory effect and rigidity-imparting effect by introducing the above-mentioned cyclic skeleton.

On the other hand, transferability becomes inferior in the case the content of the polyester resin A exceeds 20.0 mass parts. This is thought to be the result of an increase in toner hygroscopicity causing a decrease in charging characteristics of the toner.

The content of the polyester resin A is preferably from at least 1.0 mass part to not more than 10.0 mass parts based on 100.0 mass parts of the binder resin.

In the present invention, the polyester resin A having the isosorbide unit represented by formula (1) as constituent resin unit thereof can be synthesized by, for example, a method consisting of subjecting a dibasic acid or anhydride thereof (monomer), an isosorbide represented by the following formula (2) and a divalent alcohol (monomer) to dehydration condensation at a composite ratio at which carboxyl groups remain and at a reaction temperature of 180° C. to 260° C. in a nitrogen atmosphere. In addition, a trifunctional or higher polybasic acid or anhydride thereof, a monobasic acid, a trifunctional or higher alcohol or a monovalent alcohol and the like can also be used as necessary.

Examples of the above-mentioned dibasic acid or anhydrides thereof include aliphatic dibasic acids such as maleic acid, maleic anhydride, fumaric acid, itaconic acid, itaconic anhydride, oxalic acid, malonic acid, succinic acid, succinic anhydride, dodecyl succinic acid, dodecyl succinic anhydride, dodecenyl succinic acid, dodecenyl succinic anhydride, adipic acid, azelaic acid, sebacic acid or decane-1,10-dicarboxylic acid, and aromatic or alicyclic dibasic acids such as phthalic acid, tetrahydrophthalic acid or anhydrides thereof, hexahydrophthalic acid or anhydrides thereof, tetrabromophthalic acid or anhydrides thereof, tetrachlorophthalic acid or anhydrides thereof, HET acid or anhydrides thereof, himic acid or anhydrides thereof, isophthalic acid, terephthalic acid, cyclohexanedicarboxylic acid or 2,6-naphthalenedicarboxylic acid.

Examples of the above-mentioned divalent alcohol include aliphatic diols such as ethylene glycol, 1,2-propylene glycol, 1,4-butanediol, 1,5-pentanediol, 1,6-hexanediol, diethylene glycol, dipropylene glycol, triethylene glycol or neopentyl glycol, bisphenols such as bisphenol A and bisphenol F, alkylene oxide adducts of bisphenol A such as ethylene oxide adducts of bisphenol A or propylene oxide adducts of bisphenol A, alkylene glycols such as xylylene diglycol, and alicyclic diols such as 1,4-cyclohexanedimethanol or hydrogenated bisphenol A.

Examples of the above-mentioned trifunctional or higher polybasic acids and anhydrides thereof include trimellitic acid, trimellitic anhydride, methylcyclohexene tricarboxylic acid, methylcyclohexene tricarboxylic anhydride, pyromellitic acid and pyromellitic anhydride.

[Chemical Formula 3]

formula (2)

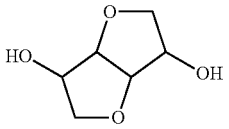

In the present invention, the acid value of the polyester resin A is preferably from at least 0.5 mgKOH/g to not more than 30.0 mgKOH/g and more preferably from at least 2.0 mgKOH/g to not more than 15.0 mgKOH/g.

When the acid value is within the above-mentioned ranges, transferability is further improved. An optimum range as described above is thought to be present based on the balance between the hygroscopicity and charging performance of the polyester resin A.

Particularly in the case of obtaining toner particles according to a suspension polymerization method and the like to be subsequently described, the acid value of the polyester resin A is preferably adjusted to within the above-mentioned range. As a result of adjusting the acid value to within the above-mentioned range, the polyester resin A added can be controlled so as to form a thin film on the surface of the toner particles or be present in the form of a gradient moving from the surface towards the center of the toner particles corresponding to the balance between polarity demonstrated by a polymerizable monomer composition to serve as the toner particles and that of an aqueous medium. As a result of using the polyester resin A for the shell of a core-shell structure in this manner, wax present in the toner is easily controlled to the above-mentioned specific contained state, thereby facilitating the obtaining of an effect that improves transferability.

Furthermore, the acid value (mgKOH/g) of the polyester resin A can be controlled according to, for example, the monomer composite ratio of the polyester resin.

In the present invention, the weight-average molecular weight (Mw) of the polyester resin A as measured by gel permeation chromatography (GPC) is preferably from at least 5000 to not more than 30000 and more preferably from at least 10000 to not more than 20000. When the molecular weight is within the above-mentioned ranges, transferability is further improved. In the case the molecular weight is within the above-mentioned ranges, dispersibility of the polyester resin A in the toner particles is further improved and it is easy to obtain the above-mentioned effects of the isosorbide unit of inhibiting polarization and imparting rigidity.

In the present invention, the state in which the wax is contained is specified as previously described.

When observing cross-sections of the toner using a transmission electron microscope (TEM), a (r/R)st determined by the following procedures (1)-(4) satisfies a relationship $0.25 \leq (r/R)st \leq 0.95$, (1) selecting twenty toner particle cross-sections, wherein each of the twenty toner particle cross-sections has a major axis R (μm) that satisfies a relationship $0.9 \leq R/D4 \leq 1.1$ with respect to a weight-average diameter D4 (μm) of the toner as measured with a flow particle image measuring apparatus, (2) determining a r/R for one toner particle cross-section out of the twenty toner particle cross-sections, wherein the r (μm) denotes the largest major axis of a domain composed of the wax present in the one toner particle cross-section, (3) determining r/Rs for nineteen toner particle cross-sections other than the one toner particle cross-section in the same manner as (2) respectively, (4) calculating an arithmetic mean of twenty r/Rs to determine a (r/R)st.

In the case the resulting arithmetic mean (r/R)st of r/R satisfies the relationship of $0.25 \leq (r/R)st \leq 0.95$, the wax can be said to be present in the toner particles by forming domains of a suitable size in a state that is incompatible with the binder resin. As a result of the wax being present so as to satisfy the above-mentioned requirement, favorable transferability is obtained due to a synergistic effect with the polyester resin A.

In the case the value of (r/R)st is less than 0.25, the effect of improving transferability is not adequately obtained. This is thought to be due to being unable to obtain the effect of inhibiting polarization as previously described since the wax is present in the toner by being dispersed therein. On the other hand, in the case the value of (r/R)st is greater than 0.95, there is a high possibility of the wax being present on the toner surface, thereby resulting in the risk of a decrease in toner storability.

The value of (r/R)st preferably satisfies the relationship of $0.25 \leq (r/R)st \leq 0.50$.

Furthermore, in the case of using a method by which the toner is prepared in an aqueous medium, the value of (r/R)st can be controlled to be within the above-mentioned range by changing the type and added amount of wax. In the present invention, the content of wax is preferably from at least 1.0 mass part to not more than 30.0 mass parts, more preferably from at least 5.0 mass parts to not more than 30.0 mass parts, and even more preferably from at least 5.0 mass parts to not more than 20.0 mass parts, based on 100.0 mass parts of the binder resin.

As a result of the wax content being within the above-mentioned ranges, both fixing performance and storability are particularly favorable.

Although there are no particular limitations on the wax able to be used in the present invention, examples thereof include petroleum-based waxes and derivatives thereof such as paraffin wax, microcrystalline wax or petrolactum, montan wax and derivatives thereof, hydrocarbon wax obtained according to the Fischer-Tropsch method and derivatives thereof, polyolefin waxes represented by polyethylene and derivatives thereof, and natural waxes such as carnauba wax or candelilla wax and derivatives thereof. Examples of the derivatives include oxides, block copolymers and graft denaturation products with vinyl monomers. In addition, other examples include ester waxes synthesized from higher aliphatic alcohols and higher fatty acids. These can be used alone or in combination.

Among these, in the case of using a polyolefin, a hydrocarbon wax obtained according to the Fischer-Tropsch method, a petroleum-based wax or a higher ester, dielectric polarization is further inhibited and the effect of improving transferability is further enhanced.

Furthermore, an antioxidant may be added to these waxes within a range that does not have an effect on toner charging performance.

The melting point of the above-mentioned wax is preferably from at least 30° C. to not more than 120° C. and more preferably from at least 40° C. to not more than 90° C. The use of a wax that exhibits thermal properties as described above results in more favorable fixing performance of the resulting toner and enables the mold release effect of the wax to be demonstrated more efficiently. As a result, in addition to ensuring additional fixing regions, conventionally known detrimental effects of wax on developability, blocking resistance and image-forming apparatuses can be eliminated.

The number average molecular weight (Mn) of the above-mentioned wax as measured by gel permeation chromatography (GPC) is preferably from at least 200 to not more than 2000 and the weight-average molecular weight (Mw) is preferably from at least 400 to not more than 3000. In addition, the ratio of Mw/Mn is preferably 3.0 or less.

When the number average molecular weight of the wax is within the above-mentioned range, toner charging performance, color mixability and compatibility with the image-forming apparatus, become favorable.

In the present invention, when the specific dielectric constant of the wax is defined as $\varepsilon w$ and the specific dielectric constant of the binder resin is defined as $\varepsilon b$, then the wax and binder resin preferably satisfy the relationship $\varepsilon w<\varepsilon b$. In the case of satisfying this relational expression, the decrease in the dielectric constant brought about by the wax can be realized more effectively, thereby allowing the obtaining of more favorable transferability of the toner.

A known resin can be used for the binder resin used in the toner of the present invention without any particular restrictions. Specific examples thereof include vinyl resin, polyester resin other than polyester resin A, polyamide resin, furan resin, epoxy resin, xylene resin and silicone resin. These resins can be used alone or as a mixture. In general, monomers are used after suitably mixing so that the theoretical glass transition temperature (Tg), as described in the Polymer Handbook, 2nd Edition, Part III, pp. 139-192 (John Wiley & Sons), becomes a value that is appropriate for toner use.

Examples of the above-mentioned vinyl resin that can be used include homopolymers and copolymers of monomers such as styrene-based monomers represented by, for example, styrene, α-methylstyrene or divinylbenzene, unsaturated carboxylic acid esters represented by, for example, methyl acrylate, butyl acrylate, methyl methacrylate, 2-hydroxyethyl methacrylate, t-butyl methacrylate or 2-ethyhexyl methacrylate, unsaturated carboxylic acids represented by, for example, acrylic acid or methacrylic acid, unsaturated dicarboxylic acids represented by, for example, maleic acid, unsaturated dicarboxylic anhydrides represented by, for example, maleic anhydride, nitrile-based vinyl monomers represented by, for example, acrylonitrile, halide-based vinyl monomers represented by, for example, vinyl chloride, and nitro-based vinyl monomers represented by, for example, nitrostyrene.

In addition, in the present invention, a crosslinking agent may be used when synthesizing the binder resin in order to further enhance toner mechanical strength.

Examples of bifunctional crosslinking agents include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester-type diacrylate (MANDA, Nippon Kayaku Co., Ltd.) and bifunctional crosslinking agents in which the aforementioned diacrylates have been substituted with dimethacrylates. Examples of polyfunctional crosslinking agents include pentaerythritol triacrylate, trimethylolethane triacrylate, trimethylolpropane triacrylate, tetramethylolmethane tetraacrylate, oligoester acrylates and polyfunctional crosslinking agents in which the aforementioned acrylates have been substituted with methacrylates, 2,2-bis(4-methacryloxypolyethoxyphenyl) propane, diallyl phthalate, triallyl cyanurate, triallyl isocyanurate and triallyl trimellitate. The added amount of these crosslinking agents is preferably from at least 0.05 mass parts to not more than 10 mass parts and more preferably from at least 0.1 mass part to not more than 5 mass parts based on 100 mass parts of other vinyl-based monomer.

The toner of the present invention may also contain a colorant. A known colorant can be used for the colorant.

Examples of organic pigments or organic dyes used as cyan-based colorants include copper phthalocyanine compounds and derivatives thereof, anthraquinone compounds and basic dye lake compounds.

Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

Examples of organic pigments or organic dyes used as magenta-based colorants include condensed azo compounds, diketopyrrolopyrolle compounds, anthraquinone compounds, quinacridone compounds, basic dye lake compounds, naphthol compounds, benzimidazolone compounds, thioindigo compounds and perylene compounds.

Specific examples include C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of organic pigments or organic dyes used as yellow-based colorants include compounds represented by condensed azo compounds, isoindolinone compounds, anthraquinone compounds, azo metal complexes, methine compounds and allylamide compounds.

Specific examples include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

Examples of black colorants include carbon black, aniline black, non-magnetic ferrite, magnetite, and black colorants obtained by adjusting to black color using the above-mentioned yellow-based colorants, magenta-based colorants and cyan-based colorants.

These colorants can be used alone or mixed, and can also be used in the form of a solid solution. These colorants are selected from the viewpoints of hue angle, chroma, lightness, lightfastness, OHP transparency and dispersibility in the toner.

The content of the colorant is preferably from at least 1 mass part to not more than 20 mass parts based on 100 mass parts of the polymerizable monomers or binder resin.

Furthermore, in the case of producing toner particles by suspension polymerization, the colorant is preferably subjected to hydrophobic treatment with a substance that does not inhibit polymerization. In addition, with respect to carbon black, in addition to subjecting to hydrophobic treatment with a substance that does not inhibit polymerization, the carbon black may also be treated with a substance that reacts with surface functional groups of the carbon black (such as a polyorganosiloxane).

In addition, the toner of the present invention can also be a magnetic toner containing a magnetic material. In this case, the magnetic material also fulfills the role of a colorant. Examples of the magnetic material include iron oxides in the manner of magnetite, hematite and ferrite, metals in the manner of iron, cobalt and nickel, and alloys of these metals and metals in the manner of aluminum, cobalt, copper, lead, magnesium, tin, zinc, antimony, beryllium, bismuth, cadmium, calcium, manganese, selenium, titanium, tungsten and vanadium, as well as mixtures thereof. The magnetic material is preferably subjected to surface modification. In the case of producing toner by suspension polymerization, hydrophobic treatment is carried out with a surface modifier that does not inhibit polymerization. Examples of such surface modifiers include silane coupling agents and titanium coupling agents.

The average particle diameter of the magnetic material is normally 1 μm or less and preferably at least 0.1 μm to not more than 1 μm. In addition, a magnetic material is used in which the magnetic properties thereof during application of a magnetic field of 795.8 kA/m (10 kilooersteds) are normally such that coercive force (HC) is at least 1.6 kA/m to not more than 24 kA/m (at least 20 oersteds to not more than 300 oersteds), saturation magnetization ($\sigma s$) is at least 50 $Am^2/kg$ to not more than 200 $Am^2/kg$, and residual magnetization ($\sigma r$) is at least 2 $Am^2/kg$ to not more than 20 $Am^2/kg$.

The toner of the present invention is preferably a toner that has toner particles and an external additive such as inorganic fine particles.

Examples of the inorganic fine particles include fine particles in the manner of silica fine particles, titanium oxide fine particles, alumina fine particles and compound oxide particles thereof. Among these inorganic fine particles, silica fine particles and titanium oxide fine particles are preferable. In addition, examples of external additives other than inorganic fine particles include various types of resin particles and fatty acid metal salts. These can be used alone or a plurality of types can be used in combination.

Examples of the silica fine particles include dry silica or fumed silica formed by vapor phase oxidation of a silicon halide, wet silica produced from water glass, and sol gel silica produced according to the sol-gel method. Dry silica is preferable for the inorganic fine particles since it has few silanol groups on the surface or inside the silica fine particles and results in little $Na_2O$ and $SO_3^{2-}$. In addition, the dry silica may also be composite fine particles of silica and other metal oxides by using another metal halide such as aluminum chloride or titanium chloride with the silicon halide in the production process.

Since subjecting the inorganic fine particles to hydrophobic treatment makes it possible to adjust toner triboelectric charge quantity, improve environmental stability and improve characteristics in high-humidity environments, fine inorganic particles that have undergone hydrophobic treatment are used preferably. If inorganic fine particles that have been added to toner absorb moisture, charge quantity of the toner tends to decrease and decreases in developability and transferability occur easily. In addition, durability also tends to decrease.

Examples of hydrophobic treatment agents of inorganic fine particles include unmodified silicone varnish, various types of modified silicon varnishes, unmodified silicone oil, various types of modified silicone oils, silane compounds, silane coupling agents, other organic silicon compounds and organic titanium compounds. These hydrophobic treatment agents may be used alone or in combination.

Among these, inorganic fine particles hydrophobically treated with silicone oil are preferable. Hydrophobically treated inorganic fine particles that have been treated with silicone oil either simultaneous to hydrophobic treatment with a coupling agent or after hydrophobic treatment with a coupling agent are more preferable due to their superior environmental characteristics. The particle diameter of these external additives is such that the number average particle diameter as determined from observations with an electron microscope and the like is preferably at least 5 nm to not more than 1000 nm. The added amount of these external additives is normally at least 0.01 mass parts to not more than 10 mass parts and preferably at least 0.05 mass parts to not more than 5 mass parts based on 100 mass parts of toner particles.

The toner of the present invention is such that increases in untransferred toner can be prevented by producing a toner having a narrow circularity distribution. In addition, since toner specific surface area decreases as the shape of toner particles becomes spherical, the effect in the case of specifying the state in which the wax is contained in the toner as previously described becomes more prominent thereby making it easier to obtain a synergistic effect with the polyester resin A.

In the toner of the present invention, the number average particle diameter D1 (μm) in a scatter diagram of circle equivalent diameter versus circularity based on the number of toner as measured with a flow particle image measuring apparatus is preferably at least 2.0 μm to not more than 10.0 μm.

In addition, more favorable transferability is obtained by precisely controlling toner particle shape so that the average circularity of the toner is from at least 0.920 to not more than 0.995.

Namely, by decreasing particle diameter so that the number average particle diameter D1 (μm) of the toner is at least 2.0 μm to not more than 10.0 μm, reproducibility of the development of image contours, and particularly the development of character images and line patterns, is favorable. In addition, the transferability of toner exhibiting a small particle diameter is further improved by making the average circularity as calculated from the frequency distribution of toner circularity to be preferably at least 0.920 to not more than 0.995, more preferably at least 0.950 to not more than 0.995, and even more preferably at least 0.970 to not more than 0.990. In particular, the above-mentioned trend is extremely effective in the case of developing digital micro spot latent images or when forming full-color images by carrying out multiple transfers using an intermediate transfer member, matching with image-forming apparatus becomes also excellent.

Moreover, the toner of the present invention has even better transferability by making the content of toner particles, in which circularity as calculated from the frequency distribution of circularity is less than 0.950, 15.0% or less.

The midpoint glass transition temperature (Tg) of the toner of the present invention is preferably at least 40° C. to not more than 75° C., more preferably at least 40° C. to not more than 65° C. and even more preferably at least 40° C. to not more than 60° C. In the case the midpoint glass transition temperature is lower than 40° C., toner storage stability and durability stability tend to decrease, and in the case of exceeding 75° C., the toner fixation point tends to rise.

The peak molecular weight (Mp) of the toner of the present invention in the molecular weight distribution thereof as measured by gel permeation chromatography (GPC) is preferably at least 5,000 to not more than 50,000, more preferably at least 5,000 to not more than 45,000, and even more preferably at least 5,000 to not more than 40,000.

When the peak molecular weight (Mp) of the toner is less than 5,000, blocking resistance and durability tend to decrease, when the peak molecular weight (Mp) exceeds 50,000, low-temperature fixability tends to decrease and it becomes difficult to obtain high gloss images.

The toner of the present invention may be applied to a single-component developing system using a single-component-based developer, or may be applied to a two-component developing system using a two-component-based developer. For example, in the case of a single-component-based developer used in a single-component developing system, by containing a magnetic material in the toner to obtain a magnetic toner, the magnetic toner can be transported and charged by using a magnet incorporated in the developing sleeve.

In addition, in the case of a using anon-magnetic toner not containing a magnetic material, the toner can be adhered on a developing roller by triboelectrically charging the toner using a blade or fur brush.

In the case of using a two-component-based developer, the magnetic carrier mixed with the toner is composed of an element selected from, for example, iron, copper, zinc, nickel, cobalt, manganese or chromium either alone or in the state of a complex ferrite. The shape of the magnetic carrier used at this time may be spherical, flat or irregular, and a magnetic carrier is used in which the microstructure of the surface state of the magnetic carrier (such as surface unevenness) is suitably controlled. In addition, a resin-coated carrier, obtained by coating the surface of the magnetic carrier with a resin, can also be used preferably. The average particle diameter of the magnetic carrier used is preferably at least 10 μm to not more than 100 μm and more preferably at least 20 μm to not more than 50 μm. In addition, the toner concentration in the developer in the case of preparing a two-component-based developer by mixing the magnetic carrier and toner is preferably at least 2 mass % to not more than 15 mass %.

Although there are no particular limitations on the method used to produce the toner of the present invention, a production method is used preferably that comprises a step for producing toner particles in an aqueous medium for the reason of facilitating specification of the state in which the wax is contained as previously described, and a production method that uses a suspension polymerization method to produce toner particles is more preferable.

In the case of obtaining toner particles by suspension polymerization, a polymerizable monomer that forms the binder resin, a wax, the polyester resin A, and as necessary, other materials such as a colorant, are mixed followed by uniformly dissolving or dispersing each component to obtain a polymerizable monomer composition. Subsequently, the polymerizable monomer composition is dispersed using a suitable stirrer in an aqueous medium containing a dispersion stabilizer as necessary to form particles of the polymerizable monomer composition. Subsequently, the polymerizable monomer contained in the particles is polymerized to obtain toner particles having a desired particle diameter. Following polymerization, the above-mentioned toner particles are filtered, washed and dried according to known methods followed by mixing with the above-mentioned external additives as necessary and adhering to the surface of the toner particles to obtain the toner of the present invention.

There are no particular limitations on the above-mentioned polymerizable monomer in the case of obtaining the toner of the present invention by suspension polymerization, an examples thereof include vinyl-based monomers described in the section explaining the binder resin.

In the case of obtaining the toner of the present invention by suspension polymerization, a polymerization initiator may also be used. There are no particular limitations on the polymerization initiator and known polymerization initiators can be used.

Specific examples thereof include azo-based or diazo-based polymerization initiators represented by, for example, 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile, and peroxide-based polymerization initiators represented by, for example, benzoyl peroxide, t-butylperoxy-2-ethylhexanoate, t-butylperoxypivalate, t-butylperoxyisobutyrate, t-butylperoxyneodecanoate, methyl ethyl ketone peroxide, diisopropylperoxycarbonate, cumene hydroperoxide, 2,4-dichlorobenzoyl peroxide and lauroyl peroxide.

In the case of obtaining the toner of the present invention by suspension polymerization, a known chain transfer agent or polymerization inhibitor and the like can also be used.

In the case of obtaining the toner of the present invention by suspension polymerization, an inorganic or organic dispersion stabilizer may also be contained in the aqueous medium. A known dispersion stabilizer can be used for the dispersion stabilizer without any particular limitations.

More specifically, examples of inorganic dispersion stabilizers include phosphates represented by, for example, hydroxyapatite, calcium triphosphate, calcium diphosphate, magnesium phosphate, aluminum phosphate or zinc phosphate, carbonates represented by, for example, calcium carbonate or magnesium carbonate, metal hydroxides represented by, for example, calcium hydroxide, magnesium hydroxide or aluminum hydroxide, sulfates represented by, for example, calcium sulfate or barium sulfate, calcium metasilicate, bentonite, silica and alumina.

In addition, examples of organic dispersion stabilizers include polyvinyl alcohol, gelatin, methyl cellulose, methyl hydroxypropyl cellulose, ethyl cellulose, carboxymethyl cellulose sodium salt, polyacrylic acid and salt thereof and starch.

In the case of obtaining the toner of the present invention by suspension polymerization, a surfactant may be further contained in the aqueous medium. There are no particular limitations on the surfactant and a known surfactant can be used. Specific examples thereof include anionic surfactants represented by, for example, sodium dodecylbenzene sulfonate or sodium oleate, cationic surfactants, amphoteric surfactants and nonionic surfactants.

In the case of using an inorganic compound for the dispersion stabilizer, although a commercially available product may be used as is, in order to obtain finer particles, the above-mentioned inorganic compound may be used after forming in an aqueous medium. For example, in the case of calcium phosphates such as hydroxyapatite or calcium triphosphate, an aqueous phosphate solution and an aqueous calcium salt solution are mixed while stirring at a high speed.

The following provides an explanation of methods for measuring physical properties of the toner of the present invention.

<Measurement of Acid Value of Polyester Resin A>

The acid value of polyester resin A is measured according to the following procedure. Acid value is the number of mg of potassium hydroxide required to neutralize the acid contained in 1 g of sample. Although the acid value of polyester resin A is measured in compliance with JIS K0070-1992, more specifically, the acid value is measured in accordance with the procedure indicated below.

(1) Reagent Preparation 1.0 g of phenolphthalein is dissolved in 90 ml of ethyl alcohol (95 vol %) followed by the addition of ion exchange water to bring to a volume of 100 ml and obtain a phenolphthalein solution.

7 g of special grade potassium hydroxide are dissolved in 5 ml of water followed by the addition of ethyl alcohol (95 vol %) to bring to a volume of 1 L. After placing in an alkaline-resistant container to prevent contact with carbon dioxide gas and the like and allowing to stand for 3 days, the solution is filtered to obtain a potassium hydroxide solution. The resulting potassium hydroxide solution is stored in an alkaline-resistant container. The factor of the above-mentioned potassium hydroxide solution is determined by placing 25 ml of 0.1 mol/L hydrochloric acid in an Erlenmeyer flask, adding several drops of the above-mentioned phenolphthalein solution, titrating with the above-mentioned potassium hydroxide solution, and determining the factor from the amount of the above-mentioned potassium hydroxide solution required to neutralize the solution. The above-mentioned 0.1 mol/L hydrochloric acid used is prepared in compliance with JIS K 8001-1998.

(2) Procedure (A) Actual Test 2.0 g of pulverized polyester resin A are accurately weighed out in a 200 ml Erlenmeyer flask followed by the addition of 100 mL of a mixed solvent of toluene and ethanol (2:1) and dissolving over the course of 5 hours. Next, several drops of indicator in the form of the above-mentioned phenolphthalein solution are added followed by titrating using the above-mentioned potassium hydroxide solution. Furthermore, the titration endpoint is taken to be the point at which the feint pink color of the indicator persists for about 30 seconds.

(B) Blank Test

Titration is carried out in the same manner as the above-mentioned procedure with the exception of not using a sample (namely, using only the mixed solution of toluene and ethanol (2:1)).

(3) Acid value is calculated by substituting the results obtained into the following equation:

$$A=[(C-B)\times f\times 5.61]/S$$

(wherein, A represents acid value (mgKOH/g), B represents the amount of potassium hydroxide solution added in the blank test (ml), C represents the amount of potassium hydroxide solution added in the actual test (ml), f represents the factor of the potassium hydroxide solution, and S represents the amount of sample (g)).

<Measurement of Molecular Weight Distribution of Polyester Resin A and Toner>

The weight-average molecular weight (Mw) and the number average molecular weight (Mn) of polyester resin A and the peak molecular weight (Mp) of the toner are measured in the manner indicated below by gel permeation chromatography (GPC).

First, the resin or toner is dissolved in tetrahydrofuran (THF) at room temperature over the course of 24 hours. The resulting solution is passed through a solvent-resistant membrane filter having a pore size of 0.2 μm (Maishori Disc, Tosoh Corp.) to obtain a sample solution. Furthermore, the concentration of components soluble in THF in the sample solution is adjusted to about 0.5 mass %. Measurements are carried out under the following conditions using this sample solution.

Apparatus: HLC8120 GPC (detector: RI) (TOSOH Corp.)

Columns: 7 columns consisting of the Shodex KF-801, 802, 803, 804, 805, 806 and 807 (Showa Denko K.K.)

Eluent: Tetrahydrofuran (THF)

Flow rate: 1.0 mL/min

Oven temperature: 40.0° C.

Sample injection volume: 0.10 mL

In calculating the molecular weight of the sample, a molecular weight calibration curve is used that is prepared using standard polystyrene resins (such as "TSK Standard Polystyrene F-850, F-450, F-288, F-128, F-80, F-40, F-20, F-10, F-4, F-2, F-1, A-5000, A-2500, A-1000 and A-500", trade names, Tosoh Corp.).

<Measurement of Wax Melting Point>

Wax melting point (peak top temperature of maximum endothermic peak) is measured in compliance with ASTM D3418-82 using a differential scanning calorimeter (Q1000, TA Instruments Inc.). The melting points of indium and zinc are used to calibrate the temperature of the apparatus detection unit, and the heat of fusion of indium is used for calibration of heat quantity. More specifically, about 3 mg of wax are accurately weighed out and placed in an aluminum pan followed by measuring at a ramp rate of 1° C./min over a measured temperature range of 30° C. to 200° C. using an empty aluminum pan as a reference. Furthermore, during measurement, the temperature is initially raised to 200° C. followed by lowering to 30° C. and subsequently raising the temperature again. The peak top temperature of the maximum endothermic peak of the DSC curve over the temperature range of 30° C. to 200° C. during this second temperature rise is taken to be the melting point of the wax. In addition, the half value width of the maximum endothermic peak at that time is taken to be the half value width of the endothermic peak of the wax.

<Measurement of Wax Molecular Weight>

In the present invention, wax molecular weight is measured in the manner indicated below by gel permeation chromatography (GPC).

Apparatus: GPC-150C (Waters Corp.)

Columns: GMH-HT (TOSHO Corp), 2 columns

Temperature: 135° C.

Solvent: o-dichlorobenzene (containing 0.1% Ionol)

Flow rate: 1.0 mL/min

Sample: Injection of 0.4 mL of sample having concentration of 0.15 mass %

In measuring under the above conditions and calculating the molecular weight of the sample, a molecular weight calibration curve is used that is prepared from monodispersed polystyrene standard samples. Moreover, molecular weight is calculated by converting from polystyrene using a conversion formula derived from the Mark-Houwink viscosity equation.

<Measurement of Specific Dielectric Constants of Wax and Binder Resin>

A power supply, an ammeter in the form of the SI 1260 Electrochemical Interface (Toyo Corp.), and a current amplifier in the form of the 1296 Dielectric Interface (Toyo Corp.), are used to measure the specific dielectric constants of the wax and binder resin.

Samples obtained by hot forming samples into the shape of a plate having a thickness of 3.0±0.5 mm using a tablet forming machine are used for the measurement samples. Circular gold electrodes having a diameter of 10 mm were fabricated on the upper and lower surfaces of the above-mentioned sample using mask vapor deposition.

Measurement electrodes are attached to the prepared measurement samples followed by applying a 100 mVp-p alternating current voltage at a frequency of 0.1 MHz and measuring capacitance. Specific dielectric constant ε of the measurement sample is then calculated from the equation indicated below.

$\varepsilon = dC/\varepsilon_0 S$ d: thickness of measurement sample (m)

C: capacitance (F)

$\varepsilon_0$: Vacuum dielectric constant (F/m)

S: Electrode surface area ($m^2$)

<Measurement of Toner Average Particle Diameter, Circularity and Frequency Distribution>

Toner average particle diameter, circularity and the frequency distribution thereof in the present invention are measured under the measurement and analysis conditions used during the calibration procedure using a flow particle image measuring apparatus (FPIA-3000, Sysmex Corp.).

The specific measurement method is as indicated below. First, about 20 mL of ion exchange water from which impure solids and the like have been removed are placed in a glass container. 0.2 mL of a dilute solution, obtained by diluting a dispersing agent in the form of "Contaminon N" (10 mass % aqueous solution of a neutral detergent having a pH of 7 for washing precision measuring instruments and composed of a nonionic surfactant, anionic surfactant and organic builder, Wako Pure Chemical Industries, Ltd.) three mass times with an ion exchange water, are added to the glass container. Moreover, about 0.02 g of measurement sample are added followed by dispersing for 2 minutes using an ultrasonic disperser to obtain a measurement dispersion. At that time, the dispersion is suitably cooled so that the temperature thereof is 10° C. to 40° C.

A prescribed amount of ion exchange water is placed in a water tank followed by the addition of 2 mL of the above-mentioned Contaminon N to the water tank using a desktop ultrasonic cleaner/disperser having an oscillation frequency of 50 kHz and electrical output of 150 W (such as the VS-150 manufactured by Velvo-Clear Co., Ltd.) for the ultrasonic disperser.

During measurement, the above-mentioned flow particle image analyzer equipped with the "UPlanApro" (magnification factor: 10×, numerical aperture: 0.40) is used for the object lens, and the "PSE-900A" Particle Sheath (Sysmex Corp.) is used for the sheath liquid. The dispersion prepared in accordance with the above-mentioned procedure is introduced into the above-mentioned flow particle image analyzer followed by counting 3000 toner particles in the HPF measurement mode using the total count mode. The distributions of circle-equivalent diameter and circularity of the toner particles are determined by setting the binarized threshold during particle analysis to 85%, and limiting the analyzed particle diameter to a circle-equivalent diameter of at least 1.985 μm to less than 39.69 μm. Weight-average molecular weight D4 (μm), number average molecular weight D1 (μm), average circularity and circularity frequency distribution (such as the ratio of toner particles having circularity of less than 0.950) are determined based on the resulting distributions.

In carrying out measurement, focus is adjusted automatically using standard latex particles prior to the start of measurement ("Research and Test Particles, Latex Microsphere Suspensions 5200A" manufactured by Duke Scientific Corp and diluted with ion exchange water). Subsequently, focus is preferably adjusted every 2 hours after the start of measurement.

Furthermore, in the examples of the present application, a flow particle image analyzer was used that had been issued a certificate of calibration by Sysmex Corp. Measurements were carried out under the same measurement and analysis conditions as those at the time of calibration certification with the exception of limiting the analyzed particle diameter to a circle-equivalent diameter of at least 1.985 μm to less than 39.69 μm.

<Measurement of Toner Midpoint Glass Transition Temperature [Tg]>

Midpoint glass transition temperature [Tg] of the toner is measured in compliance with ASTM D3418-82 using the "Q1000" Differential Scanning calorimeter (TA Instruments Inc.). The melting points of indium and zinc are used to calibrate the temperature of the detection unit, and the heat of fusion of indium is used for calibration of heat quantity.

More specifically, 5 mg of toner are accurately weighed out and placed in an aluminum pan and an empty aluminum pan is used as a reference. Modulation measurement is carried out set to a ramp rate of 1° C./min over a measured temperature range of 20° C. to 140° C. and temperature amplitude of ±0.318° C./min. The change in specific heat is obtained over a temperature range of 20° C. to 140° C. during the course of heating.

The midpoint glass transition temperature [Tg] of the toner is the temperature of the intersection of a line at an equal distance in the direction of the vertical axis from a line extending from each baseline before and after the appearance of a change in specific heat on a reversible specific heat change curve, and a curve at the portion of a stepwise change in glass transition.

<Calculation of (r/R)st>

(1) Observation of Toner Cross-sections Using Transmission Electron Microscope (TEM)

In the present invention, an electron staining method is used in which contrast is generated between materials by enhancing the electron density of one component with a heavy metal utilizing the difference in microstructures between a crystal phase and an amorphous phase.

More specifically, after adequately dispersing the toner in a cold-setting epoxy resin, the resin is cured for 2 days at an atmospheric temperature of 40° C. The resulting cured product is electron-stained by combining the use of ruthenium tetraoxide ($RuO_4$) and osmium tetraoxide ($OsO_4$). Subsequently, samples are cut out in the form of thin sections using an ultramicrotome equipped with a diamond knife. Next, the samples in the form of thin sections are placed in the chamber of a vacuum electron staining apparatus (VSC4R1H manufactured by Filgen Inc.) followed by carrying out electron staining at a concentration of 5 and staining time of 15 minutes, and using the stained samples to observe cross-sections of the toner particles by enlarging at a magnification factor of 10,000× to 20,000× using a transmission electron microscope (TEM) (Tecnai TF20XT Electron Microscope manufactured by FEI Co.).

Examples of toner cross-sections able to be observed with the above-mentioned method are shown in FIG. 1.

(2) Calculation of r/R and (r/R)st

A (r/R)st is determined by the following procedures (a)-(d).

(a) twenty toner particle cross-sections are selected from the toner particle cross-sections observed using the above-mentioned method, where each of the twenty toner particle cross-sections has a major axis R (μm) that satisfies a relationship 0.9≤R/D4≤1.1 with respect to a weight-average diameter D4 (μm) of the toner as measured with a flow particle image measuring apparatus, (b) one toner particle cross-section is selected out of the twenty toner particle cross-sections, and a r/R for the one toner particle cross-section is determined, where the r (μm) denotes the largest major axis of a domain composed of the wax present in the one toner particle cross-section, the R (μm) denotes the major axis of the one toner particle cross-section.

(c) r/Rs for nineteen toner particle cross-sections other than the one toner particle cross-section are determined in the same manner as (b) respectively.

(d) an arithmetic mean of twenty r/Rs is calculated to determine a (r/R)st.

EXAMPLES

Although the following provides an explanation of the present invention through examples thereof, the present invention is not limited by these examples. Furthermore, the terms "parts" described in the examples examples are all based on mass unless specifically indicated otherwise.

(Production of Polyester (PES) Resin A-1)

100 parts of a mixture obtained by mixing raw material monomers other than trimellitic anhydride in the charged amounts shown in Table 1 and 0.52 parts of a catalyst in the form of bis(2-ethylhexanoic acid)tin were placed in polymerization tank equipped with a nitrogen feed tube, dehydration line and stirrer and carried out condensation polymerization reaction for 6 hours at 200° C. in a nitrogen atmosphere. Moreover, trimellitic anhydride was added after raising the temperature to 210° C. followed by carrying out a condensation reaction under reduced pressure at 40 kPa. The acid value (mgKOH/g) and molecular weight of the resulting resin were as shown in Table 1. This resin was designated as Polyester Resin (PES) Resin A-1.

Furthermore, the isosorbide shown in the table refers to a compound having a structure represented by the following formula (2).

[Chemical Formula 4]

formula (2)

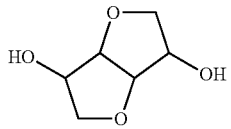

(Production of Polyester Resins A-2 to A-10)

Polyester resins A-2 to A-10 were produced by carrying out the same procedure as Polyester Resin A-1 using the charged amounts of the raw material monomers and condensation polymerization reaction temperature conditions shown in Table 1. The physical properties of the resulting polyester resins are shown in Table 1.

TABLE 1

| | | | Resin A-1 | Resin A-2 | Resin A-3 | Resin A-4 | Resin A-5 | Resin A-6 | Resin A-7 | Resin A-8 | Resin A-9 | Resin A-10 |
|---|---|---|---|---|---|---|---|---|---|---|---|---|
| Monomer composition* (molar ratio) | Acid | TPA | 45.00 | 45.20 | 45.20 | 43.10 | 42.10 | 48.60 | 49.80 | 45.20 | 45.20 | 45.20 |
| | | IPA | 44.20 | 44.00 | 43.80 | 42.10 | 41.20 | 45.20 | 46.80 | 44.10 | 44.00 | 44.10 |
| | | TMA | 1.30 | 1.30 | 1.30 | 1.30 | 1.30 | 1.30 | 1.30 | 1.30 | 1.30 | 1.30 |
| | Alcohol | BPA(PO) | 64.00 | 29.80 | 71.00 | 55.20 | 55.20 | 54.40 | 54.40 | 68.50 | 25.80 | 68.30 |
| | | BPA(EO) | 16.00 | 33.00 | 26.00 | 25.60 | 25.60 | 25.70 | 25.70 | 30.50 | 31.20 | 31.20 |
| | | isosorbide | 20.00 | 37.20 | 3.00 | 19.20 | 19.20 | 19.90 | 19.90 | 0.10 | 43.00 | 0.50 |

TABLE 1-continued

| | | | Resin A-1 | Resin A-2 | Resin A-3 | Resin A-4 | Resin A-5 | Resin A-6 | Resin A-7 | Resin A-8 | Resin A-9 | Resin A-10 |
|---|---|---|---|---|---|---|---|---|---|---|---|---|
| Isosorbide unit (mol %) | | | 10.50 | 19.53 | 1.58 | 10.29 | 10.40 | 10.20 | 10.06 | 0.05 | 22.57 | 0.26 |
| Condensation polymerization temperature (° C.) | | | 200 | 200 | 200 | 210 | 210 | 200 | 200 | 200 | 200 | 200 |
| Resin physical properties | Acid value | | 7.0 | 6.8 | 7.2 | 1.0 | 0.3 | 28.0 | 32.9 | 6.5 | 6.8 | 6.9 |
| | Molecular weight | Mw | 12000 | 12300 | 12100 | 13200 | 14100 | 12000 | 11500 | 12300 | 13000 | 12500 |
| | | Mn | 2800 | 2800 | 2700 | 3100 | 3300 | 2200 | 2000 | 2800 | 3000 | 2800 |

*Monomer composition indicates the molar ratio based on a value of 100 for the total number of moles of the alcohol component.

The following abbreviations are used in the table.

TPA: Terephthalic acid

IPA: Isophthalic acid

TMA: Trimellitic acid

BPA(PO): 3-mole propylene oxide adduct of bisphenol A

BPA(EO): 2-mole ethylene oxide adduct of bisphenol A

Mw: Weight-average molecular weight

Mn: Number average molecular weight

Example 1

<Toner 1 Production Example>

(Preparation of Aqueous Medium)

| | |
|---|---|
| Ion exchange water | 400.0 parts |
| Trisodium phosphate | 7.0 parts |

The above-mentioned mixture was held at 60° C. while stirring with a Clearmix high-speed stirring apparatus (M Technique Co., Ltd.) at a rotating speed of 15,000 rpm. Next, 4.1 parts of calcium chloride were added to prepare an aqueous medium containing an inorganic dispersion stabilizer.

(Preparation of Polymerizable Monomer Composition 1)

| | |
|---|---|
| Styrene | 40.0 parts |
| Copper phthalocyanine pigment (Pigment Blue 15:3) | 6.5 parts |
| LR-147 charge control agent (Japan Carlit Co., Ltd.) | 0.3 parts |

The above-mentioned materials were mixed followed by stirring with an attritor (Mitsui Mining Co., Ltd.) for 4 hours at 200 rpm together with zirconia beads (3/16 inch) and removing the beads to prepare a pigment dispersion (pigment dispersion step).

(Preparation of Polymerizable Monomer Composition 2)

| | |
|---|---|
| Styrene | 35.0 parts |
| n-butyl acrylate | 25.0 parts |
| Polyester Resin A-1 | 4.0 parts |

The above-mentioned materials were mixed followed by stirring for 2 hours to dissolve the Polyester Resin A-1 and obtain Polymerizable Monomer Composition 2.

(Preparation of Polymerizable Monomer Composition 3: Dissolution Step)

Polymerizable Monomer Compositions 1 and 2 were mixed followed by adding the materials indicated below.

| | |
|---|---|
| Fischer-Tropsch wax (melting point: 78° C., specific dielectric constant: 2.4) | 10.0 parts |
| Divinylbenzene | 0.02 parts |

After adding the above-mentioned materials, the mixture was heated to 60° C. followed by continuing to stir for 10 minutes to obtain Polymerizable Monomer Composition 3.

(Granulation and Polymerization Steps)

The resulting Polymerizable Monomer Composition 3 was added to the above-mentioned aqueous medium. Next, 10.0 parts of t-butylperoxypivalate (25% toluene solution) were added followed by granulating for 10 minutes while maintaining a stirrer rotating speed of 15000 rpm. Subsequently, after changing from a high-speed stirrer to a propeller stirring blade, the internal temperature was raised to 70° C. followed by reacting for 5 hours while stirring slowly. Next, the temperature inside the container was raised to 85° C. and the polymerization reaction was further carried out for 4 hours.

(Distillation, Washing, Drying, Classification and External Addition Steps)

Following completion of the polymerization reaction, the toluene and residual monomers were distilled off while heating under reduced pressure followed by cooling and adding hydrochloric acid to lower the pH to 2.0 or lower and dissolve the inorganic dispersion stabilizer. After further filtering and rinsing with water, drying was carried out for 72 hours at 40° C. using a dryer. Fine powder and coarse powder in the resulting dried product were simultaneously classified and removed with an elbow-jet air classifier (Nittetsu Mining Co., Ltd.) to obtain Cyan Toner Particles 1.

1.0 parts of hydrophobic silica having a BET specific surface area of 200 $m^2/g$ and 0.3 parts of titanium oxide having a BET specific surface area of 100 $m^2/g$ were added externally to 100.0 parts of the Toner Particles 1 for 300 seconds with a Henschel mixer (Mitsui Mining Co., Ltd.) to obtain Toner 1. The physical properties of the resulting Toner 1 are shown in Table 2. Here, the value of the specific dielectric constant measured for Binder Resin 1 to be subsequently described was used for the specific dielectric constant of the binder resin.

Transferability was evaluated for Toner 1 in the manner indicated below. The resulting evaluation results are shown in Table 3.

<Evaluation of Transferability>

Transferability was evaluated using a laser beam printer (trade name: LBP7700C, Canon, Inc.) at 15° C. and 10% RH (low-temperature, low-humidity environment). Furthermore, the above-mentioned laser beam printer (trade name: LBP7700C) is an electrophotographic apparatus employing a four-way tandem system having an intermediate transfer belt. A cyan cartridge filled with 120 g of the above-mentioned Toner 1 was installed at the cyan station of the above-mentioned laser beam printer, and dummy cartridges were installed at the other stations followed by outputting images. The following evaluation was carried out after outputting the initial image and 10,000 printouts of images having a coverage rate of 1%. Letter-size Xerox 4200 paper (Xerox Corp., 75 g/m$^2$) was used for the image output paper.

The transfer efficiency of toner from the electrophotographic photosensitive drum (also simply referred to as the "photosensitive drum") to the transfer paper was measured. A solid image measuring 10 cm$^2$ was formed on the photosensitive drum and developing bias was adjusted so that the toner laid-on level on the photosensitive drum was 0.45 mg/cm$^2$. An unfixed image was then output, the weight of toner on the photosensitive drum (W1) and the weight of toner on the paper following transfer (W2) were measured, and transfer efficiency was calculated according to the equation indicated below.

$$\text{Transfer efficiency}(\%)=(W2/W1)\times 100$$

A4-size CLC paper (Canon, Inc., 80 g/m$^2$) was used for the transfer paper.

(Evaluation Criteria)

Rank A: Transfer efficiency of 94% or more

Rank B: Transfer efficiency of at least 92% to less than 94%

Rank C: Transfer efficiency of at least 90% to less than 92%

Rank D: Transfer efficiency of less than 90%

Examples 2 to 14

<Toner 2 to 14 Production Examples>

Toners 2 to 14 were obtained by changing the polyester resin A and wax used in the production example of Toner 1 to the formulation conditions shown in Table 2. Here, the specific dielectric constant of the ester wax in Example 4 was 2.4. The resulting Toners 2 to 14 were evaluated in the same manner as Toner 1. The resulting evaluation results are shown in Table 3.

Comparative Examples 1 and 2

<Toner 15 and 16 Production Examples>

Toners 15 and 16 were obtained by changing the polyester resin A and wax used in the production example of Toner 1 to the formulation conditions shown in Table 2. The resulting Toners 15 and 16 were evaluated in the same manner as Toner 1. The resulting evaluation results are shown in Table 3.

Comparative Example 3

<Toner 17 Production Example>

Toner 17 was obtained under the same conditions as in the production example of Toner 1 with the exception of not adding Polyester Resin A-1. The resulting Toner 17 was evaluated in the same manner as Toner 1. The resulting evaluation results are shown in Table 3.

Comparative Examples 4 and 5

<Toner 18 and 19 Production Examples>

Polyester Resins A-8 and A-9 were respectively added instead of the Polyester Resin A-1 used in the production example of Toner 1.

Toners 18 and 19 were obtained under the same conditions with the exception of the above alteration. The resulting Toners 18 and 19 were evaluated in the same manner as Toner 1. The resulting evaluation results are shown in Table 3.

Comparative Example 6

<Toner 20 Production Example>

A toner was produced according to the pulverization method in accordance with the procedure indicated below.

A styrene-butyl acrylate copolymer (St/Ba=75/25 (based on mass), Tg=54° C., Mp=25,000, specific dielectric constant=3.2) was prepared by suspension polymerization. Furthermore, di-t-butylperoxide was used as polymerization initiator. The resulting copolymer was designated as Binder Resin 1.

| | |
|---|---|
| Binder Resin 1 | 100.0 parts |
| Fischer-Tropsch wax (melting point: 78° C.) | 10.0 parts |
| Copper phthalocyanine pigment (Pigment Blue 15:3) | 6.5 parts |
| LR-147 charge control agent (Japan Carlit Co., Ltd.) | 0.3 parts |
| Polyester Resin A-1 | 4.0 parts |

After preliminarily mixing the above-mentioned materials with a Henschel mixer, the mixture was kneaded with a twin-screw kneading extruder set to a temperature of 110° C. After cooling the resulting kneaded product and coarsely pulverizing with a cutter mill, the product was finely pulverized with a pulverizer using a jet air flow. Fine powder and coarse powder of the resulting finely pulverized product were simultaneously classified and removed with an elbow-jet air classifier (Nittetsu Mining Co., Ltd.) to obtain Cyan Toner Particle 20.

External addition treatment was carried out in the same manner as Toner 1 using the resulting Toner Particle 20 to obtain Toner 20. The physical properties of the resulting Toner 20 are shown in Table 2. In addition, the resulting Toner 20 was evaluated in the same manner as Toner 1. The resulting evaluation results are shown in Table 3.

TABLE 2

| | Formulation Conditions | | | | | | Toner Physical Properties | | | | | | |
|---|---|---|---|---|---|---|---|---|---|---|---|---|---|
| | PES Resin A | | Wax | | | Binder resin | | | | | | | |
| Toner | Type | Content (mass parts) | Type | Specific dielectric constant | Content (mass parts) | Specific dielectric constant | Mid point Tg (° C.) | Peak molecular weight (Mp) | Wax contained state (r/R)st | Number average diameter D1 (μm) | Weight average diameter D4 (μm) | Average circularity | (1)* |
| 1 | A-1 | 4.0 | (A)* | 2.4 | 10.0 | 3.2 | 54 | 28000 | 0.38 | 5.3 | 6.7 | 0.979 | 9.5 |
| 2 | A-1 | 4.0 | (A)* | 2.4 | 5.0 | 3.2 | 55 | 27000 | 0.26 | 5.2 | 6.6 | 0.975 | 10.0 |

TABLE 2-continued

| | Formulation Conditions | | | | | | Toner Physical Properties | | | | | | |
|---|---|---|---|---|---|---|---|---|---|---|---|---|---|
| | PES Resin A | | Wax | | | Binder resin | Mid | Peak | Wax | Number | Weight | | |
| Toner | Type | Content (mass parts) | Type | Specific dielectric constant | Content (mass parts) | Specific dielectric constant | point Tg (° C.) | molecular weight (Mp) | contained state (r/R)st | average diameter D1 (μm) | average diameter D4 (μm) | Average circularity | (1)* |
| 3 | A-1 | 4.0 | (A)* | 2.4 | 30.0 | 3.2 | 55 | 28000 | 0.65 | 5.3 | 6.5 | 0.982 | 8.3 |
| 4 | A-1 | 4.0 | (B)* | 2.4 | 10.0 | 3.2 | 53 | 28000 | 0.36 | 5.1 | 6.4 | 0.985 | 5.7 |
| 5 | A-1 | 1.0 | (A)* | 2.4 | 10.0 | 3.2 | 54 | 29000 | 0.35 | 5.0 | 6.2 | 0.978 | 6.9 |
| 6 | A-1 | 10.0 | (A)* | 2.4 | 10.0 | 3.2 | 54 | 28000 | 0.36 | 5.4 | 6.7 | 0.980 | 6.8 |
| 7 | A-1 | 20.0 | (A)* | 2.4 | 10.0 | 3.2 | 54 | 28000 | 0.38 | 5.1 | 6.8 | 0.973 | 8.2 |
| 8 | A-2 | 4.0 | (A)* | 2.4 | 10.0 | 3.2 | 54 | 28000 | 0.34 | 5.2 | 6.4 | 0.975 | 9.8 |
| 9 | A-3 | 4.0 | (A)* | 2.4 | 10.0 | 3.2 | 55 | 27000 | 0.39 | 5.1 | 6.5 | 0.978 | 5.7 |
| 10 | A-4 | 4.0 | (A)* | 2.4 | 10.0 | 3.2 | 53 | 27000 | 0.35 | 5.3 | 6.8 | 0.979 | 13.2 |
| 11 | A-5 | 4.0 | (A)* | 2.4 | 10.0 | 3.2 | 54 | 28000 | 0.36 | 5.4 | 7.0 | 0.982 | 14.2 |
| 12 | A-6 | 4.0 | (A)* | 2.4 | 10.0 | 3.2 | 53 | 28000 | 0.38 | 4.9 | 6.3 | 0.981 | 8.4 |
| 13 | A-7 | 4.0 | (A)* | 2.4 | 10.0 | 3.2 | 54 | 28000 | 0.38 | 4.9 | 6.5 | 0.980 | 9.6 |
| 14 | A-10 | 4.0 | (A)* | 2.4 | 10.0 | 3.2 | 54 | 28000 | 0.39 | 5.2 | 6.6 | 0.980 | 8.5 |
| 15 | A-1 | 4.0 | (A)* | 2.4 | 2.0 | 3.2 | 54 | 27000 | 0.04 | 5.2 | 6.4 | 0.980 | 8.6 |
| 16 | A-1 | 30.0 | (A)* | 2.4 | 10.0 | 3.2 | 54 | 28000 | 0.33 | 5.2 | 6.9 | 0.978 | 12.0 |
| 17 | — | — | (A)* | 2.4 | 10.0 | 3.2 | 55 | 28000 | 0.36 | 5.5 | 7.2 | 0.978 | 6.6 |
| 18 | A-8 | 4.0 | (A)* | 2.4 | 10.0 | 3.2 | 54 | 28000 | 0.32 | 5.4 | 6.8 | 0.982 | 9.8 |
| 19 | A-9 | 4.0 | (A)* | 2.4 | 10.0 | 3.2 | 55 | 28000 | 0.33 | 5.3 | 6.6 | 0.980 | 10.8 |
| 20 | A-1 | 4.0 | (A)* | 2.4 | 10.0 | 3.2 | 54 | 25000 | 0.03 | 6.3 | 8.5 | 0.936 | 33.9 |

In the Table 2,
(1)* denotes percentage of particles having circularity of less than 0.950 (number %)
(A)* denotes Fischer-Tropsch wax (melting point: 78° C.)
(B)* denotes ester wax (melting point: 72° C.)

TABLE 3

| | | Initial transferability | | Transferability after durability testing | |
|---|---|---|---|---|---|
| | Toner No. | Rank | Transfer efficiency (%) | Rank | Transfer efficiency (%) |
| Example 1 | 1 | A | 96 | A | 95 |
| Example 2 | 2 | A | 96 | A | 95 |
| Example 3 | 3 | A | 95 | B | 93 |
| Example 4 | 4 | A | 96 | A | 95 |
| Example 5 | 5 | A | 96 | A | 94 |
| Example 6 | 6 | A | 96 | A | 95 |
| Example 7 | 7 | A | 95 | B | 93 |
| Example 8 | 8 | A | 94 | B | 93 |
| Example 9 | 9 | A | 96 | A | 95 |
| Example 10 | 10 | A | 96 | B | 93 |
| Example 11 | 11 | A | 95 | B | 92 |
| Example 12 | 12 | A | 94 | B | 93 |
| Example 13 | 13 | A | 94 | B | 92 |
| Example 14 | 14 | A | 94 | B | 92 |
| Comparative Example 1 | 15 | B | 92 | C | 91 |
| Comparative Example 2 | 16 | B | 93 | C | 91 |
| Comparative Example 3 | 17 | C | 91 | C | 90 |
| Comparative Example 4 | 18 | B | 93 | C | 90 |
| Comparative Example 5 | 19 | B | 92 | D | 89 |
| Comparative Example 6 | 20 | C | 90 | D | 86 |

Favorable results were obtained in Examples 1 to 14 in the evaluations of initial transferability and transferability after durability testing. On the other hand, results inferior to those of the examples were obtained for Comparative Examples 1 to 6 in the evaluation of transferability after durability testing. Namely, results were observed in the comparative examples that did not achieve the level of the present invention with respect to durability and transferability during high-speed printing.

On the basis of the above results, the present invention is able to provide a toner that demonstrates favorable durability and is able to maintain a high level of transferability during high-speed printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-038035, filed Feb. 28, 2014 which is hereby incorporated by reference herein in its entirety.

What is claimed is:

1. A toner comprising a toner particle, wherein the toner particle has a core-shell structure constituted by a core portion and a shell portion, the core portion contains a binder resin and a wax, and the shell portion contains a polyester resin A, the polyester resin A comprising an isosorbide unit represented by formula (1)

(1)

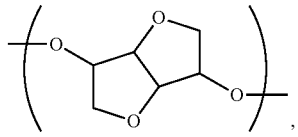

the polyester resin A being a polymerization product obtained by condensation polymerization of:

(i) a dicarboxylic acid or anhydride thereof, wherein the dicarboxylic acid is selected from the group consisting of maleic acid, fumaric acid, itaconic acid, oxalic acid, malonic acid, succinic acid, dodecyl succinic acid, dodecenyl succinic acid, adipic acid, azelaic acid, sebacic acid, decane-1,10-dicarboxylic acid, phthalic acid, tetrahydrophthalic acid, hexahydrophthalic acid, tetrabromophthalic acid, tetrachlorophthalic acid, HET acid, himic acid, isophthalic acid, terephthalic acid, cyclohexanedicarboxylic acid and 2,6-naphthalenedicarboxylic acid, (ii) an isosorbide represented by formula (2)

(2)

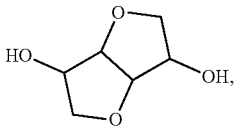

(iii) a divalent alcohol other than the isosorbide, wherein the divalent alcohol is selected from the group consisting of ethylene glycol, 1,2-propylene glycol, 1,4-butanediol, 1,5-pentanediol, 1,6-hexanediol, diethylene glycol, dipropylene glycol, triethylene glycol, neopentyl glycol, bisphenol A, bisphenol F, ethylene oxide adducts of bisphenol A, propylene oxide adducts of bisphenol A, xylylene diglycol, 1,4-cyclohexanedimethanol and hydrogenated bisphenol A, and (iv) at least one compound selected from the group consisting of a tricarboxylic acid, a tetracarboxylic acid, a tricarboxylic acid anhydride, and a tetracarboxylic acid anhydride, wherein the tricarboxylic acid is trimellitic acid or methylcyclohexene tricarboxylic acid, the tetracarboxylic acid is pyromellitic acid, the tricarboxylic acid anhydride is trimellitic acid anhydride or methylcyclohexene tricarboxylic acid anhydride, and the tetracarboxylic acid anhydride is pyromellitic acid anhydride, the isosorbide unit is contained in a molar ratio of 1.58 to 10.50 mol % based on a total number of monomer units constituting the polyester resin A, an acid value of the polyester resin A is 2.0 to 15.0 mgKOH/g, a content of the polyester resin A is 1.0 to 10.0 mass parts based on 100.0 mass parts of the binder resin, and when observing a cross-section of the toner using a transmission electron microscope (TEM), $0.25 \leq (r/R)st \leq 0.50$, where $(r/R)st$ is an arithmetic mean of twenty r/R calculations determined by:

(1) selecting twenty toner particle cross-sections, each of the twenty toner particle cross-sections has a major axis R (μm) that satisfies a relationship $0.9 \leq R/D4 \leq 1.1$ with respect to a weight-average diameter D4 (μm) of the toner as measured with a flow particle image measuring apparatus, and (2) determining r/R for each of the twenty toner particle cross-sections, wherein the r (μm) denotes the largest major axis of a domain composed of the wax present in the one toner particle cross-section.

2. The toner according to claim 1, wherein a weight-average molecular weight (Mw) of the polyester resin A as measured by gel permeation chromatography is 5000 to 30000.

3. The toner according to claim 1, wherein a content of the wax is 5.0 to 30.0 mass parts based on 100.0 mass parts of the binder resin.

4. The toner according to claim 1, wherein the binder resin comprises vinyl resin.

5. The toner according to claim 1, wherein the toner particle is produced by dispersing in an aqueous medium a polymerizable monomer composition comprising the polyester resin A, the wax and a polymerizable monomer that forms the binder resin, forming a particle of the polymerizable monomer composition, and polymerizing the polymerizable monomer contained in the particle.

6. The toner according to claim 1, which satisfies $\varepsilon w < \varepsilon b$ wherein $\varepsilon w$ is a specific dielectric constant of the wax and $\varepsilon b$ is a specific dielectric constant of the binder resin.

7. The toner according to claim 1, wherein the polyester resin A is a polymerization product obtained by condensation polymerization of an isosorbide represented by formula (2)

(2)

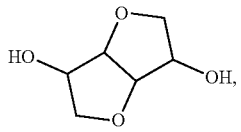

terephthalic acid, isophthalic acid, trimellitic acid, propylene oxide adduct of bisphenol A and ethylene oxide adduct of bisphenol A.

* * * * *